United States Patent [19]

Jordan et al.

[11] Patent Number: 4,795,102

[45] Date of Patent: Jan. 3, 1989

[54] DISHWASHER PUMP WITH PARTICLE CUTTER

[75] Inventors: Lawrence J. Jordan; Charles W. Pille, both of Newton, Iowa

[73] Assignee: Maytag Corporation, Newton, Iowa

[21] Appl. No.: 128,938

[22] Filed: Dec. 4, 1987

[51] Int. Cl.[4] ..... B02C 18/42

[52] U.S. Cl. ..... 241/46 R; 134/115 G; 241/100.5; 241/101.2

[58] Field of Search ..... 134/115 G; 415/121 B, 415/121 G; 241/101.2, 257 G, 89.4, 257 R, 185 A, 46 R, 46.17, 84, 46 A, 100.5, 46 B, 46.02, 46.11, 46.06, 46.08, 69, 292.1

[56] References Cited

U.S. PATENT DOCUMENTS

| | | | |
|---|---|---|---|
| 3,156,278 | 11/1964 | Otto . | |
| 3,434,671 | 3/1969 | Cushing et al. | 241/46 |
| 3,981,456 | 9/1976 | Hahn et al. | 241/46 R |
| 4,072,277 | 2/1978 | Seydelmann | 241/292.1 |
| 4,134,555 | 1/1979 | Rosselet | 241/100.5 X |
| 4,201,345 | 5/1980 | Ziegler | 241/46 R |
| 4,350,306 | 9/1982 | Dingler et al. | 241/46.15 |
| 4,448,359 | 5/1984 | Meyers | 241/46.06 |

*Primary Examiner*—Mark Rosenbaum
*Attorney, Agent, or Firm*—Richard L. Ward

[57] ABSTRACT

A bidirectional dishwasher pump includes a particle cutter adjacent the ingress to the drain pump cavity. The particle cutter is associated with the pump drive shaft and includes a primary edge portion and a secondary edge portion. Rotation in a first direction effects cutting of particles by the primary edge portion and rotation in a second direction effects relatively reduced particle cutting and radial outward movement of particles by the secondary edge portion.

10 Claims, 3 Drawing Sheets

DISHWASHER PUMP WITH PARTICLE CUTTER

BACKGROUND OF THE INVENTION

This invention relates generally to the field of dishwasher pumps and more particularly to a pump having an improved cutter system for cutting or comminuting food and miscellaneous particles carried by dishwashing fluid. A cutter constructed in accordance with the teachings of the instant invention is rotatable in two directions add provides a first degree of cutting or comminution in one direction and a second lesser degree of cutting in the opposite direction of rotation.

Several cutter designs for dishwasher pumps and food blenders have been utilized by the appliance industry. One typical cutter is disclosed in U.S. Pat. No. 3,156,278 issued Nov. 10, 1964 to Otto. This patent is directed to a food blender having arcuate blades with a trailing edge in the direction of rotation. The arcuate blades are pivotally connected to a single direction drive shaft. There is no suggestion of a cutter having different operating characteristics in two directions of rotation.

Cushing et al, in U.S. Pat. No. 3,434,671, issued Mar. 25, 1969, teach macerating means for a dishwashing pump having a single blade extending outward along a generally radial line and having a pivotal connection to the drive shaft of the drive motor. The blade includes a cutting edge, is closely spaced from a grid-like grading element at the pump inlet and is operable in a single direction for macerating food particles.

Hahn et al, in U.S. Pat. No. 3,981,456 issued Sept. 21, 1976, and Ziegler, in U.S. Pat. No. 4,201,345 issued May 6, 1980, each disclose a cutter formed from wire and attached to the shaft of the drive motor for rotation thereby. The wire cutter is rotated adjacent a grading element having grid-like openings for effecting the maceration of food particles. Again the cutter rotates in only one direction.

Dingler et al, in U.S. Pat. No. 4,350,306 issued Sept. 21, 1982, teach a combination recirculating and drain pump construction with a soft food disposer having a chopper blade formed to provide turbulent agitation of dishwashing liquid immediately upstream of a filter screen. The blade is formed from a flat sheet and a radially extended arm is twisted about a generally horizontal radial axis to provide a form for effecting the turbulent action.

Meyers, in U.S. Pat. No. 4,448,359 issued May 15, 1984, discloses a dishwasher drain pump which includes an impeller having means for cutting food particles. The impeller has a disc-shaped base with a plurality of soil sizing orifices and an upstanding peripheral rim. At least one breaker tooth extends upwardly from the base and passes by a stationary tooth extending downwardly from a cover plate. Food particles are sheared by the breaker tooth and stationary tooth and pass through the orifices in the base of the impeller prior to being pumped out of the drain cavity. The pump disclosed in this patent is operable in two directions but the cutting action of the drain impeller is the same in both directions of rotation.

The prior art has thus shown a number of different cutters usable with dishwasher pumps to effect comminution of food and other particles carried by the dishwashing liquid. Several of these dishwasher pumping systems are unidirectional for pumping fluid in only one direction and thus there is no concern with the effects of rotating the cutter blade in an opposite direction. The prior bidirectional pumping systems which rotate in one direction for recirculation and in another direction for drain maintain similar cutter operating characteristics in both directions of rotation. It is believed that there has been no showing in the prior art of the proposed dishwasher pump with a food cutter system wherein a vigorous first degree of cutting is provided in one direction of rotation and wherein a second lesser degree of cutting is provided in the opposite direction of rotation.

SUMMARY OF THE INVENTION

It is therefore an object of the instant invention to provide an improved food and particle cutter for a dishwasher pump.

It is a further object of the instant invention to provide a food and particle cutter for a dishwasher pump having improved cutting characteristics when rotated in one direction and substantially reduced cutting characteristics when rotated in the other direction.

Briefly, the instant invention achieves these objects in a dishwasher pump having a drive shaft and a drive motor for rotating the drive shaft in first and second directions. The pump further includes a pump housing coaxially associated with the drive shaft and including a sump, a pumping chamber within the housing and substantially coaxial with the drive shaft and having fluid ingress and egress openings. An impeller is rotatably attached to the drive shaft for moving fluid between the ingress and egress openings when rotated in one of the first or second directions. A strainer is secured to the housing upstream from the pumping chamber. A cutter is mounted on the drive shaft for rotation therewith in spaced juxtaposition to the ingress opening. The cutter includes a body having a first portion for effecting a first degree of particle comminution when the cutter is rotated in the first direction. The cutter body further includes a second portion for effecting a relatively lesser second degree of particle comminution when the cutter is rotated in the second direction.

Details of the dishwasher pump with food and particle cutter and further objects and advantages thereof will become evident as the description proceeds and from an examination of the accompanying three sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
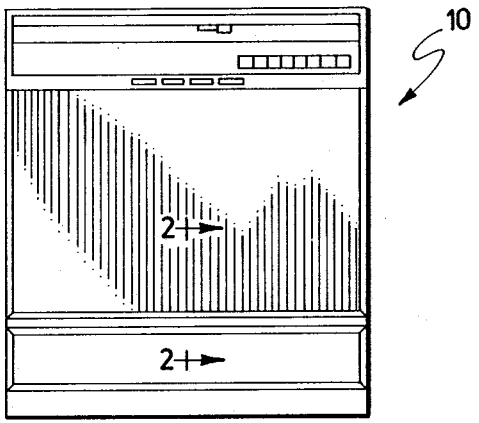
FIG. 1 is a front elevation view of a dishwasher.

Referring now to the drawings and in particular to FIG. 1, there is shown a front elevation view of a typical dishwasher 10 incorporating the teachings of the instant invention. This dishwasher 10 may be either portable or built into cabinetry adjacent to a household water supply and a drain system.

Figure 2:
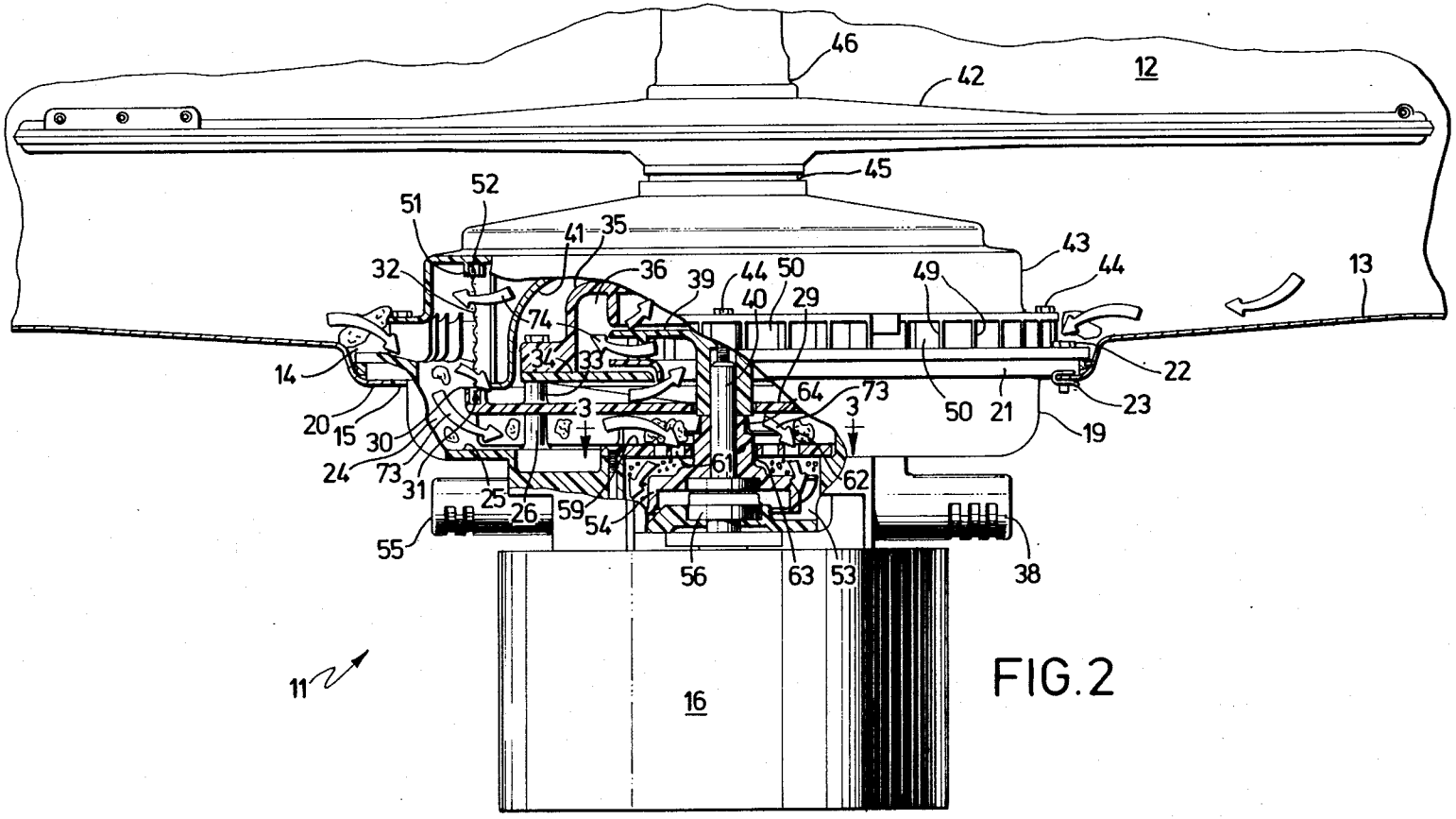
FIG. 2 is a fragmentary section view taken generally along lines 2—2 of FIG. 1 and showing a dishwasher pump module installed in the dishwasher.

As best shown in FIG. 2, the dishwasher 10 of FIG. 1 includes an integral motor-pump module 11 which is generally centrally disposed in a tub or fluid container 12 of the dishwasher 10. The tub or fluid container 12 includes, as shown in FIG. 2, a bottom wall 13 which has a generally central recess 14 and opening 15 in which the integral motor-pump module 11 is positioned. A fractional horsepower drive motor 16 is mounted below the pump housing 19 and is rotatable in a first direction for effecting the recirculation of washing fluid within the tub or fluid container 12 and in a second direction for removing washing fluid from the tub or fluid container 12 as will be further discussed herein.

As again shown in FIG. 2, the central recess 14 in the bottom wall 13 includes a flange 20 for mounting the integral motor-pump module 11. The pump portion of the motor-pump module 11 includes the pump housing 19 which is annular in shape. The pump housing 19 has a flange 21 which is mechanically secured to the flange 20 associated with the central recess 14 by a plurality of threaded fasteners 22 and retainer clips 23. A first portion of the pump housing 19 depends from the bottom wall 13 and defines a generally annular sump 24 communicating with and facing generally upward toward the interior of the tub 12.

Figure 3:
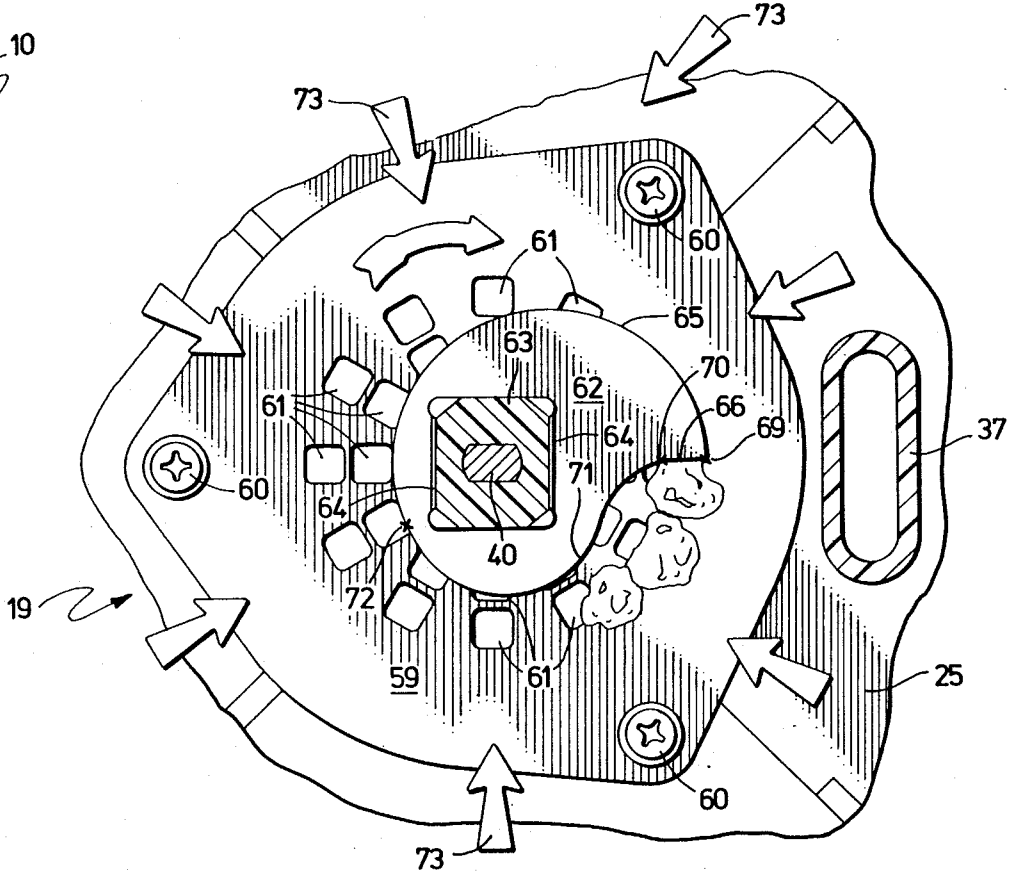
FIG. 3 is shown out of order on the first sheet of drawings with FIG. 1 and is a fragmentary view taken generally along lines 3—3 of FIG. 2 showing the action of the cutter of the instant invention when rotated in a clockwise direction for draining dishwashing liquid from the dishwasher.
Figure 4:
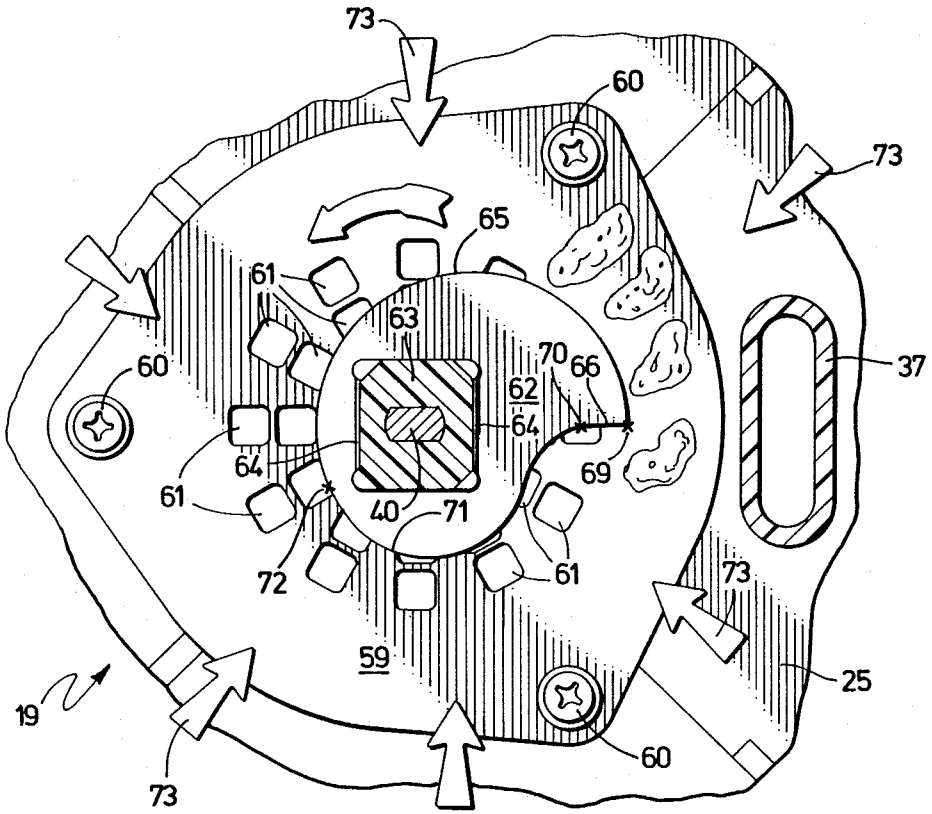
FIG. 4 is a fragmentary view similar to FIG. 3 but showing the action of the cutter when the pump is rotated in a counterclockwise direction for recirculation of dishwashing liquid within the dishwasher.

Vertically spaced above the base 25 of the annular sump 24 and mounted on a plurality of bosses 26 extending upward from the base 25 is an annular filter support plate 29. The outer periphery of the filter support plate 29 has an upwardly facing groove 30 which receives the lower end ring 31 of an annular and cylindrical fine mesh filter screen 32. The filter support plate 29 further includes a plurality of upwardly projecting bosses 33. Mounted on these bosses 33 is an annular suction plate 34 and a pump discharge housing 35 which together define a first pumping chamber or pump cavity 36 housing a recirculation impeller 39 which is mechanically secured t the end of the drive shaft 40 of the drive motor 16. FIGS. 3 and 4 show, in cross-section, a generally oblong fluid conduit 37 which provides an internal fluid flow path between the discharge housing 35 and the conduit 38 of FIG. 2 which carries recirculating washing fluid to a top wash arm (not shown). Also located within the confines of the annular filter screen 32 is a filter wash arm 41 which is rotatably associated with the wash arm 42 and rotates around the pump discharge housing 35 to backwash food particle from the filter screen 32.

An upper housing portion or cover 43 is attached to the pump housing 19 along the flange 21 by threaded fasteners 44 as further shown in FIG. 2. The annular cover 43 is substantially imperforate and includes a generally central opening 45 for accommodating an upwardly extending fluid distribution conduit 46 extending between the pump discharge housing 35 and the wash arm 42. A seal is disposed at the opening 45. Along the periphery of the cover 43 are a plurality of generally upstanding ribs 49. The ribs 49 are radially spaced around the periphery of the cover 43 to define a plurality of tunnels 50 having a generally 90° turn between the bottom wall 13 and the pump sump 24. The tunnels 50 have approximately one-half inch by one-half inch openings for passing food and other miscellaneous particles up to about that size into the pump sump 24. The outer periphery of the cover 43 thus defines a strainer between the tub 12 and the sump 24 for preventing the flow of food and other miscellaneous particles larger than the predetermined size of the tunnels 50 into the sump 24.

An inside surface of the cover 43 defines a downwardly facing annular groove 51 generally aligned with the upwardly facing groove 30 in the filter support plate 29. This groove 51 receives the upper end ring 52 of the annular and cylindrical filter screen 32. The filter screen 32 effectively divides the sump 24 so that only filtered dishwashing fluid is allowed to enter the inlet of the recirculation impeller 39 which is radially within or downstream relative to the filter screen 32.

Still referring to FIG. 2, disposed below the base 25 of the annular sump 24 and generally coaxial with the shaft 40 of the drive motor 16 is a substantially annular drain pump cavity 53. The drain pump cavity 53 houses an axial flow drain impeller 54 mounted on the shaft 44 of the drive motor 16 and axially spaced from the recirculation impeller 39. The drain impeller 54 is operable for directing the flow of fluid from the sump 24 to an external drain through the conduit 55. Disposed below the drain impeller 54 is a seal 56 for effectively preventing fluid from entering the drive motor 16.

Turning now to FIGS. 3 and 4 in addition to FIG. 2, there is shown a food and particle chopper disc or plate 59 located above and substantially covering the annular opening to the drain pump cavity 53. The chopper disc o plate 59 is mechanically secured to the base 25 of the pump housing 19 by means of a plurality of fasteners 60 to effect a peripheral seal of the drain pump cavity 53. The chopper disc or plate 59 has a radially extending grid-like pattern of generally square apertures 61 which extend through the thickness of the chopper disc or plate 59 and allow washing fluid and cut or comminuted food and other particles to be drawn into the drain pump cavity 53 by the drain impeller 54. In this embodiment, the apertures 61 are three-sixteenths inch square but it is anticipated that the apertures 61 could be configured in a number of other geometric shapes and sizes.

Positioned axially above the chopper plate 59 is a cutter blade 62 mounted on and rotatable with the drain pump impeller 54 to effect first and second degrees of food and particle cutting dependent on the direction of rotation. The cutter blade 62 is positively secured o the shaft 63 of the drain pump impeller 54 for rotation therewith in a plane substantially parallel with the plane of the chopper plate 59. The shaft 63 of the drain pump impeller 54 is generally square in cross section at the upper end as shown in FIGS. 3 and 4. The cutter blade 62 has a corresponding square opening and a pair of upwardly extending fingers 64 tapering angularly inward and which frictionally engage the square cross section of the shaft 63 to hold the cutter blade 62 on the shaft 63.

As further shown in FIGS. 2–4, the cutter blade 62 is formed from generally flat sheet steel and is preferably a stainless steel. In the plan views of FIGS. 3 and 4, it can be seen that the cutter blade 62 has a substantially "scimitar" shape indicated by numeral 65. The cutter blade 62 is unsymmetrical about the vertical center line of the drive shaft 40 and, as viewed in FIGS. 3 and 4, a generally linear edge 66 extends radially inward toward the vertical center line from the maximum radius at point 69 of the convex "scimitar" shape 65. The edge 66 is presented to food and miscelleneous other particles during one direction of rotation to effect a first relatively vigorous and fine degree of cutting or chopping. When rotated in the other direction, the "scimitar" shape 65 provides a lesser degree of cutting while effectively moving particles away from the apertures 61 in the chopper plate 59.

The cutter blade 62 can alternatively be described as having about a one-eighth inch long linear portion extending radially inward toward the rotational axis of the drain impeller 54 from a first predetermined radial point 69 to a second predetermined radial point 70. This linear portion defines the one edge 66 of the cutter blade 62. The cutter blade 62 further has a double curve or "ogee" shape 71 between the second radial point 70 and a third predetermined radial point 72. A generally spiral portion extends between the third and first radial points 72 and 69 and defines the "scimitar" shape 65 previously discussed.

As best illustrated in FIG. 3, when the drive motor 16 rotates in the clockwise or drain direction, as viewed when looking downwardly from inside the dishwasher tub, the edge 66 of the cutter blade 62 is presented to food and other particles which have passed through the tunnels 50 of the cover 43 substantially along the path shown by the arrows 73. The edge 66 cooperates with the generally square apertures 61 in the chopper plate 59 to cut or comminute the particles so that they may pass through the apertures 61 and be pumped from the drain pump cavity 53 toward an external drain.

When the drive motor 16 rotates in the counterclockwise or recirculation direction, as shown in FIG. 4, to pump washing liquid along the path depicted by the arrows 74 in FIG. 2, the "scimitar" shape 65 contacts the particles and provides a greatly reduced cutting action. The particles in the sump 24 are moved generally radially outward from the vicinity of the entrance to the drain pump cavity 53 to reduce interaction between the cutter blade 62 and the apertures 61 in the chopper plate 59.

Figure 5:
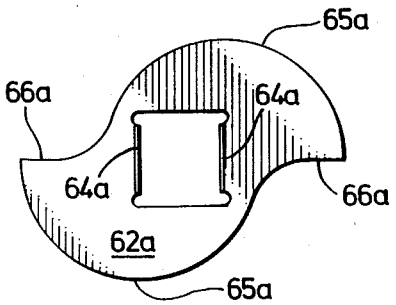
FIG. 5 is an alternate embodiment of the cutter.

It is further alternately anticipated, as shown in FIG. 5, that the cutter **62*a* could be formed to include a pair of edges 66*a* located approximately 180° apart and a pair of spirally extending edges 65*a*. This alternate embodiment would also provide the desired first vigorous and second less vigorous degrees of particle cutting depending on the direction of rotation of the cutter blade 62*a*. In addition to the alternate embodiment of FIG. 5, it is anticipated that other alternate embodiments of the cutter 62** are possible which would be encompassed by the teachings of the instant invention.

The bidirectional dishwasher pump described herein includes a greatly improved cutter for comminuting particles in the dishwashing fluid. The cutter includes an edge which engages and effectively and efficiently cuts or comminutes particles when rotated in a first direction. The cutter also includes an outwardly spirally extending "scimitar" edge which greatly reduces the comminution process when the cutter is rotated in a second direction while moving particles generally radially outward from the drain pump entrance.

In the drawings and specification, there has been set forth a preferred embodiment of the invention and although specific terms are employed these are used in a generic and descriptive sense only and not for purposes of limitation. Changes in the form and the proportion of parts as well as the substitution of equivalents are contemplated as circumstances may suggest or render expedient without departing from the spirit or scope of the invention and further defined in the following claims.

We claim:

1. A dishwasher pump having a drive shaft, a drive motor for rotating the drive shaft in first and second directions, a pump housing associated with the drive shaft including a sump, a pumping chamber within the housing and substantially coaxial with the drive shaft and having fluid ingress and egress openings, an impeller rotatably attached to the drive shaft for moving fluid between the ingress and egress openings when rotated in one of the first or second directions, strainer means secured to the housing upstream from the pumping chamber, wherein the improvement comprises: cutter means mounted on said drive shaft for rotation therewith in spaced juxtaposition to said ingress opening and including a body having a first portion for effecting a first degree of particle comminution when said cutter means is rotated in said first direction, said body further including a second portion for effecting a relatively lesser second degree of particle comminution when said cutter mean is rotated in said second direction.

2. A dishwasher pump as defined in claim 1 wherein said first portion includes a generally radially extending edge and said second portion includes a nonradial edge having a radially enlarging dimension.

3. A dishwasher pump as defined in claim 2 wherein the edge of said first portion is relatively straight and the edge of said second portion extends spirally outward.

4. A dishwasher pump having a drive shaft, a drive motor for rotating the drive shaft in first and second directions, a pump housing associated with the drive shaft including a sump, a pumping chamber within the housing and substantially coaxial with the drive shaft and having fluid ingress and egress openings, an impeller rotatably attached to the drive shaft for moving fluid between the ingress and egress openings when rotated in one of the first or second directions, a strainer secured to the housing upstream from the pumping chamber and having a plurality of openings of predetermined size allowing fluid and particles up to about the predetermined opening size to enter the sump, wherein the improvement comprises: cutter means mounted on said drive shaft for rotation therewith in spaced juxtaposition to said ingress opening and including structure defining a body having at least one substantially linear first edge portion radially spaced from the rotational axis of said drive shaft for engaging with and effecting a generally fine degree of particle comminution when said cutter means is rotated in said first direction, said body further including a least one second edge portion extending spirally outward relative to said rotational axis for effecting a relatively lesser degree of particle comminution and for moving said particles radially outward from said ingress opening when said cutter means is rotated in said second direction.

5. A dishwasher pump as defined in claim 4 wherein said body of said cutter means is of generally uniform thickness and is mounted eccentrically on said drive shaft.

6. In a dishwasher having a container defining a washing chamber with a bottom wall and a generally central opening therein, a dishwasher pump having a drive shaft, a drive motor for rotating the drive shaft in first and second directions, a pump housing fixed to the bottom wall and depending from the central opening to define a generally annular sump in fluid communication with the washing chamber, a cover attached to the pump housing including a strainer allowing particles up to a predetermined size to enter the sump, a pumping chamber having an inlet and an outlet, an apertured structure overlying the inlet with the apertures sized to allow particles generally smaller than those passed by the strainer to enter the pumping chamber, an impeller rotatably attached to the drive shaft for effecting the flow of fluid between the inlet and outlet when rotated in one of the first or second directions, wherein the improvement comprises: cutter means associated with said drive shaft and said impeller and in close operating proximity to said apertured structure upstream from said inlet, said cutter means including body structure having a generally outwardly spiraling portion relative to said rotational axis defining an edge having minimal particle comminuting capability, said body structure further including a linear portion extending radially inward from the maximum radius of said spiraling portion toward said rotational axis defining an edge with enhanced particle comminuting capability as compared to said spiraling portion, said cutter means being rotatable in one direction for engaging said linear edge with and comminuting particles into a size suitable for passage through said apertures into said pumping chamber and rotatable in the opposite direction to engage said spiraling edge with said particles for generally reduced particle comminution while moving said particles radially outward from said rotational axis.

7. A dishwasher as defined in claim 6 wherein said outwardly spiraling portion of said body structure is substantially scimitar shaped.

8. A dishwasher pump having a drive shaft, a drive motor for rotating the drive shaft in first and second directions, a pump housing associated with the drive shaft including a sump, a pumping chamber within the housing and substantially coaxial with the drive shaft and having fluid ingress and egress openings, an impeller rotatably attached to the drive shaft for moving fluid between the ingress and egress openings when rotated in one of the first or second directions, strainer means secured to the housing upstream from the pumping chamber, wherein the improvement comprises: cutter means rotatably associated with said drive shaft in spaced juxtaposition to said ingress opening, said cutter means including body structure having means defining primary and secondary edge portions extending oppositely and in a generally common plane between first and second predetermined points that are radially spaced from the rotational axis of said drive shaft, said cutter means rotatable with said drive shaft in said first direction for engaging said primary edge portion with particles to be comminuted and effecting efficient comminution thereof and rotatable with said drive shaft in said second direction for engaging said secondary edge portion with particles to effect a relatively less efficient comminuting action and the movement of particles radially outward from said rotational axis.

9. A dishwasher pump as defined in claim 8 wherein said first and second predetermined points of said body structure are located on a common line extending radially from said rotational axis.

10. A dishwasher pump as defined in claim 8 wherein said secondary edge portion of said body structure includes an ogee curve between said second predetermined point and a third predetermined point and a scimitar shaped portion between said third and first predetermined points.

* * * * *